US007982577B2

(12) United States Patent
Yu

(10) Patent No.: US 7,982,577 B2
(45) Date of Patent: Jul. 19, 2011

(54) SAFETY DEVICE FOR SWITCH

(76) Inventor: Tsung Mou Yu, Taipei (TW)

( * ) Notice: Subject to any disclaimer, the term of this patent is extended or adjusted under 35 U.S.C. 154(b) by 175 days.

(21) Appl. No.: 12/477,131

(22) Filed: Jun. 3, 2009

(65) Prior Publication Data

US 2010/0308952 A1 Dec. 9, 2010

(51) Int. Cl.
*H01H 71/16* (2006.01)

(52) U.S. Cl. ..... 337/66; 337/59; 337/62; 337/72; 337/97

(58) Field of Classification Search ..... 337/62, 337/59, 66, 72, 97; 200/553, 339, 341
See application file for complete search history.

(56) References Cited

U.S. PATENT DOCUMENTS 3,106,621 A * 10/1963 Angel ..... 200/461
4,258,349 A * 3/1981 Flory ..... 337/46
5,491,460 A * 2/1996 Krasser et al. ..... 337/70
5,539,371 A * 7/1996 Yu ..... 337/66
5,828,284 A * 10/1998 Huang ..... 337/37
5,982,269 A * 11/1999 Sorenson ..... 337/380
6,072,381 A * 6/2000 Yu ..... 337/37
6,094,126 A * 7/2000 Sorenson ..... 337/37
6,252,490 B1 * 6/2001 Lin ..... 337/79
6,275,133 B1 * 8/2001 Chen ..... 337/37
6,275,134 B1 * 8/2001 Chen ..... 337/37
6,307,459 B1 * 10/2001 Yu ..... 337/37
6,400,250 B1 * 6/2002 Wang ..... 337/66
6,452,125 B1 * 9/2002 Yu ..... 200/553
6,469,610 B1 * 10/2002 Chen ..... 337/66
6,483,416 B2 * 11/2002 Yu ..... 337/126
6,525,639 B1 * 2/2003 Cheng ..... 337/37
6,538,553 B2 * 3/2003 Yu ..... 337/365
6,864,453 B1 * 3/2005 Yu ..... 200/520
6,884,955 B1 * 4/2005 Yu ..... 200/553
6,940,389 B1 * 9/2005 Yu ..... 337/66
7,005,957 B2 * 2/2006 Yu ..... 337/66
7,026,906 B2 * 4/2006 Huang ..... 337/59
7,202,769 B2 * 4/2007 Yu ..... 337/66
7,283,031 B2 * 10/2007 Huang ..... 337/66
7,292,129 B2 * 11/2007 Yu ..... 337/66
7,307,506 B2 * 12/2007 Yu ..... 337/94
7,626,482 B2 * 12/2009 Huang ..... 337/59
2003/0011461 A1 * 1/2003 Yu ..... 337/89
2003/0071710 A1 * 4/2003 Yu ..... 337/66
2003/0137390 A1 * 7/2003 Huang ..... 337/37
2005/0264392 A1 * 12/2005 Yu ..... 337/66

FOREIGN PATENT DOCUMENTS

CH 647094 A * 12/1984

* cited by examiner

*Primary Examiner* — Anatoly Vortman

(57) ABSTRACT

A safety device for a switch includes a first terminal, a second terminal and a conductive plate connected between the two terminals. A first contact point is connected to an end of the second terminal. The conductive plate has a first end fixed to the first terminal and a second contact point connected to a second end of the conductive plate and corresponding to the first contact point. A push rod is located at a side of the conductive plate and a gap is defined between the distal end of the push rod and the conductive plate. The push rod pushes a mediate portion of the conductive plate when the mediate portion of the conductive plate is overheating to bend toward the push rod under a current overload condition. The push rod applies a force to further separate the first and second contact points so as to ensure the circuit is cut off.

7 Claims, 5 Drawing Sheets

SAFETY DEVICE FOR SWITCH

BACKGROUND OF THE INVENTION

1. Field of the Invention

The present invention relates generally to a safety device, and in particular to a push rod of a safety device of a switch, wherein the push rod ensures that a conductive plate is deformed to cut off the circuit.

2. The Prior Arts

A conventional safety device for a switch is used to electrically connect the two terminals when the circuit is in "ON" status and electrically separate the two terminals when the circuit is in "OFF" status. As shown in FIGS. 1 and 2, the safety device includes a bi-metallic plate 201 which has one end fixed to the first terminal 202 and a first contact point 203 connected to the distal end of the bi-metallic plate 201. The second terminal 204 includes a second contact point 205 which is located corresponding to the first contact point 203. When the first and second contact points 203, 205 are in contact with each other, the circuit is in "ON" status and the circuit is in "OFF" status when the first and second contact points 203, 205 are separated.

The safety device is designed to avoid a circuit from being burnt under an overload condition, which generates a high temperature to burn or melt the circuit. The bi-metallic plate 201 is made of two different metal materials and is formed to a plate shape that can deform toward an opposite direction under the overload condition. When the circuit is in "ON" status, the be-metallic plate 201 bends toward the second terminal 204 to keep the first and second contact points 203, 205 in contact with each other as shown in FIG. 1. When the circuit is overloaded, the high temperature makes the bi-metallic plate 201 deform toward an opposite direction so that the first contact point 203 is separated from the second contact point 205 to cut off the circuit as shown in FIG. 2. Accordingly, the electrical appliances can avoid from being burnt.

The bi-metallic plate 201 is made of two different metal materials with different expansion coefficients. When the bi-metallic plate 201 is heated, the bi-metallic plate 201 will deform toward the opposite direction to separate the first and second contact points 203, 205. However, there are several shortcomings for the conventional safety device as follows:

(a) The bi-metallic plates 201 do not trip off perfectly as expected on every time deformation. This is because the bi-metallic plates 201 may have different lengths, thicknesses and ingredients of each of the metal materials, so that some of the bi-metallic plates 201 do not trip off as expected at a pre-set temperature.

(b) The bi-metallic plates 201 do not trip off under overheating condition, which fails to achieve the purpose of protection of the switch.

(c) If the bi-metallic plate 201 does not trip off completely and the circuit is still in "ON" status, the circuit remains at the overheating status and may damage the electrical appliances.

(d) If the bi-metallic plate 201 does not completely trip off, the first and second contact points will be in contact with each other again when the temperature of the circuit goes down within a short period of time. The circuit becomes to be connected and cutoff frequently alternatively, so that the current supplied to the electrical appliances is not stable and the electrical appliances are likely to be damaged.

SUMMARY OF THE INVENTION

The present invention intends to resolve the problem that the conventional bi-metallic plate does not trip off or cannot trip off completely under an overload condition. The conventional bi-metallic plate cannot cut off the circuit at the preset temperature and may re-connect the circuit and disconnect the circuit frequently alternatively, thereby generating sparks and an unstable current which may damage the electrical appliances.

The safety device of the present invention comprises a first terminal and a second terminal, wherein a first contact point is connected to an end of the second terminal. A conductive plate has a first end fixed to the first terminal and a second contact point is connected to a second end of the conductive plate. The second contact point is located corresponding to the first contact point. A push rod is made of a temperature-durable material located between the first and the second terminals. The push rod is located at a side of the conductive plate and a gap is defined between a distal end of the push rod and the conductive plate. Under a current overload condition, the conductive plate is bent and deformed to move the second contact point away from the first contact point, a mediate portion of the conductive plate is bent downward to the push rod and the push rod applies a force to the conductive plate to move in a direction away from the first contact point so as to ensure that the first and second contact points are separated.

A primary objective of the present invention is to provide a safety device for a switch wherein a push rod is located at a side of the conductive plate and a gap is defined between the push rod and the conductive plate. When the conductive plate is deformed due to overheating, the push rod contacts with the conductive plate and pushes the conductive plate to ensure that the first and second contact points are separated to cut off the circuit.

Another objective of the present invention is to provide a safety device for a switch wherein the push rod is made of temperature-durable material or wear-proof material such as metal, such that the gap between the conductive plate and the push rod will not be changed as a result of the high temperature of the conductive plate.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
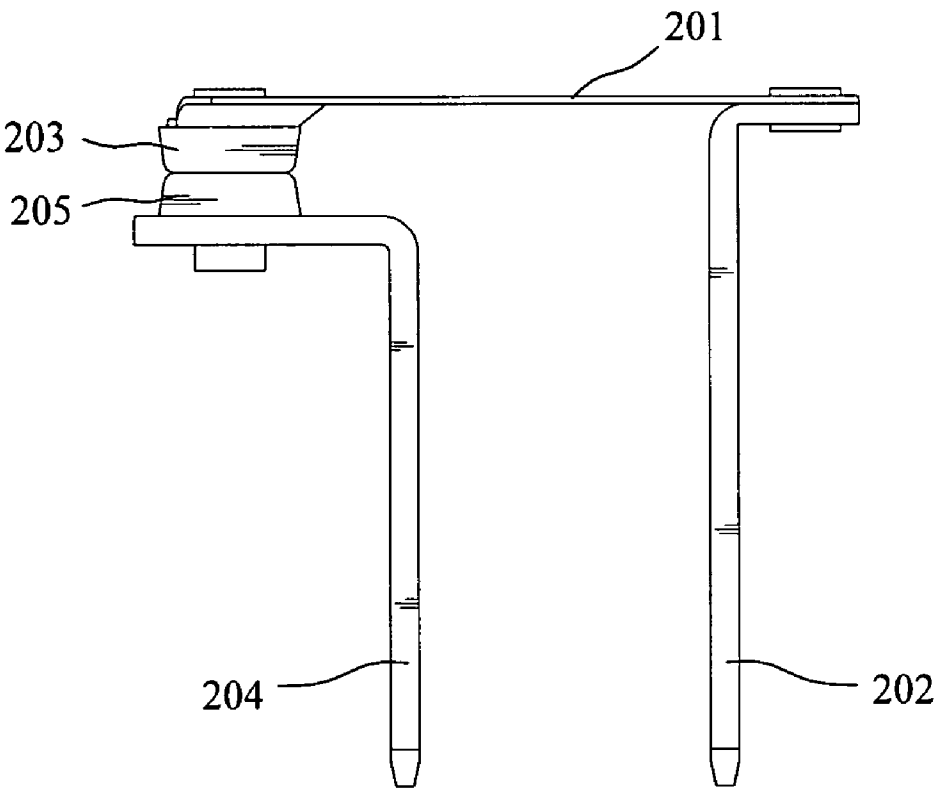
FIG. 1 (PRIOR ART)
FIG. 1 shows that the circuit is in "ON" status of a conventional safety device.
Figure 2:
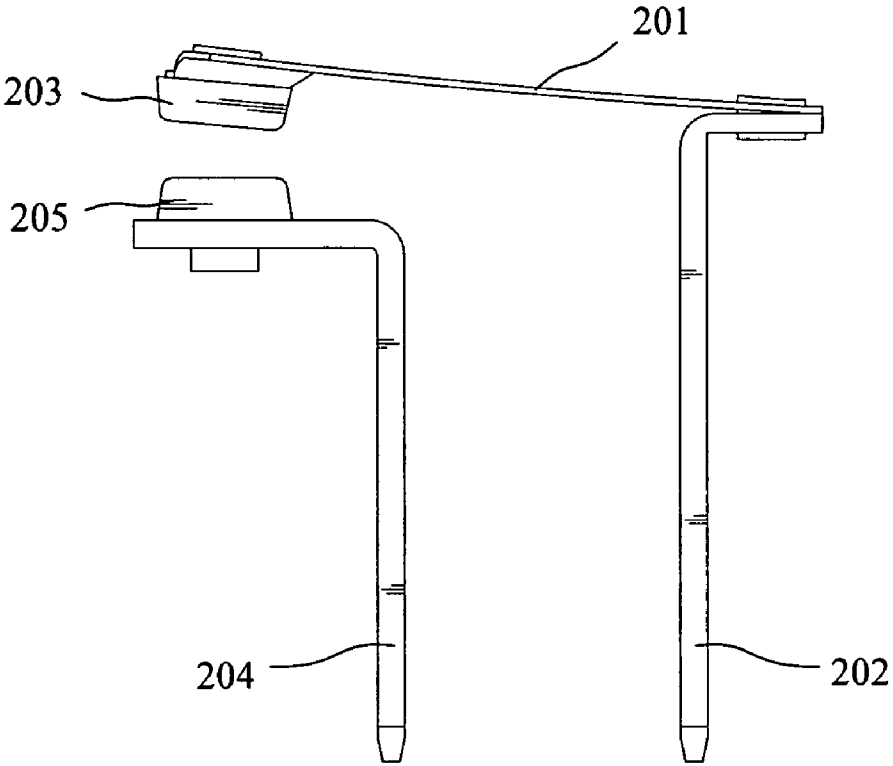
FIG. 2 (PRIOR ART)
FIG. 2 shows that the first and second contact points are separated to cut off the circuit of the conventional safety device.
Figure 3:
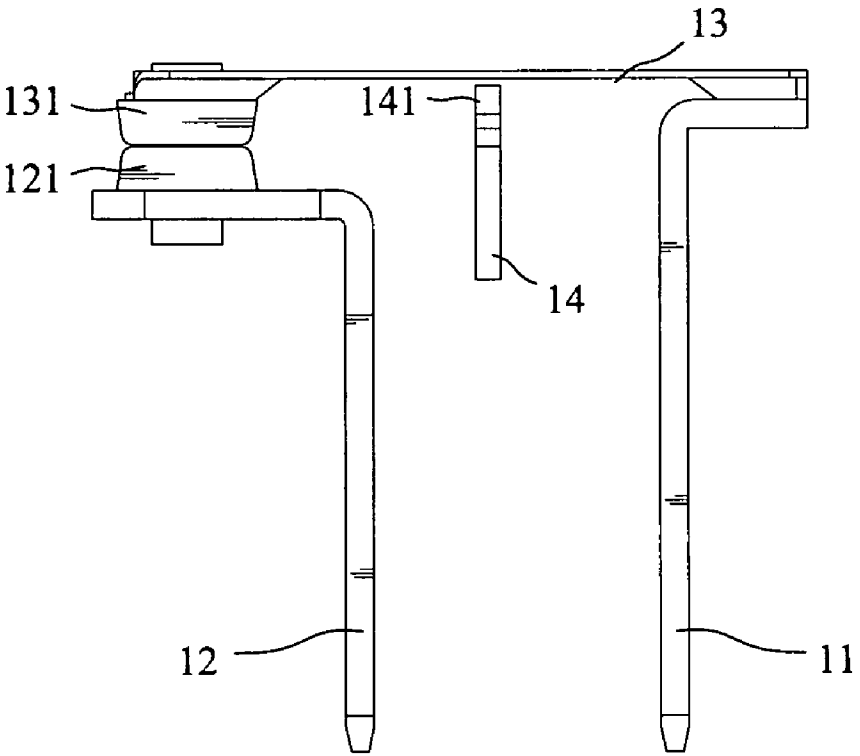
FIG. 3 shows that the circuit is in "ON" status of a safety device of the present invention.

With reference to the drawings and in particular to FIG. 3, a safety device in accordance with the present invention is provided, comprising a first terminal 11, a second terminal 12, a conductive plate 13, and a push rod 14. All of the parts mentioned are assembled in a casing which is not shown.

The first and second terminals 11, 12 are connected to the casing so as to form a circuit, in which a first contact point 121 is connected to an end of the second terminal 12.

The conductive plate 13 is of a metallic and flexible plate which is able to bend toward either of two sides thereof, specifically, the conductive plate 13 bends toward in an opposite direction when the conductive plate 13 is overheating. In the present embodiment, the conductive plate 13 is made of an alloy metal having a first end fixed to the first terminal 11 and a second contact point 131 connected to a second end of the conductive plate 13. The second contact point 131 is located corresponding to the first contact point 121. The second end of the conductive plate 13 bends toward a direction away from the first contact point 121 when the conductive plate 13 is overheating.

The push rod 14 is fixed in the casing and located between the first and the second terminals 11, 12. The push rod 14 is substantially perpendicular to the conductive plate 13. In the present embodiment, the distal end 141 of the push rod 14 is of a round shape which points the conductive plate 13 and has a gap defined between the conductive plate 13 and the push rod 14. However, the distal end 141 of the push rod 14 can be of a flat shape or includes a protrusion such as a triangular protrusion.

As shown in FIG. 3, which shows that the circuit is in "ON" status and the second end of the conductive plate 13 faces downward, the first and the second contact points 121, 131 are in contact with each other. The circuit is formed via the first terminal 11, the first contact point 121, the second contact portion 131, the conductive plate 13 and the second terminal 12.

Figure 4:
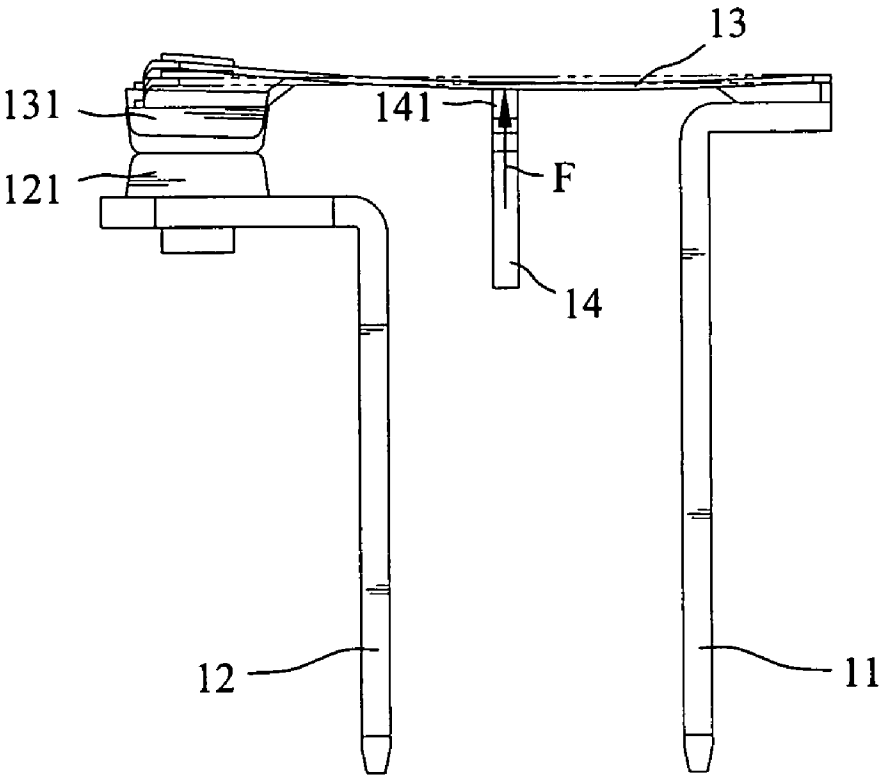
FIG. 4 shows that the first and second contact points are separated to cut off the circuit of the safety device of the present invention and the push rod pushes the conductive plate.
Figure 5:
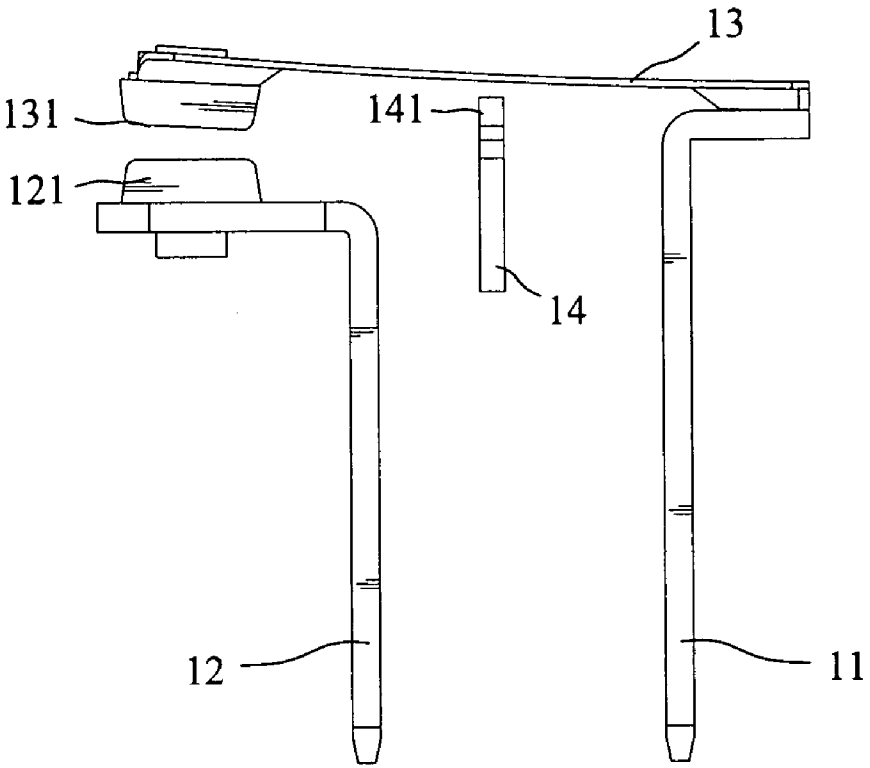
FIG. 5 shows that the first and second contact points are separated to cut off the circuit because the push rod pushes the conductive plate.

As shown in FIG. 4, which shows that the conductive plate 13 bends and the push rod 14 is in contact with the conductive plate 13. FIG. 5 shows that the circuit is in "OFF" status and the first and second contact points 121, 131 are separated from each other.

When the circuit is in an overload or a too high temperature condition, the second end of the conductive plate 13 bends upward and the mediate portion of the conductive plate 13 bends downward. The mediate portion of the conductive plate 13 contacts the distal end 141 of the push rod 14 which applies a force "F" upward to the mediate portion of the conductive plate 13. The force "F" further helps to separate the first and second contact points 121, 131 to ensure that the circuit is cut off.

Generally, when the conductive plate 13 bends, the mediate portion of the conductive plate 13 contacts the push rod 14. The high temperature of the conductive plate 13 is transferred to the distal end 141 of the push rod 14 so that the distal end 141 is melted or worn out after a period of time. This enlarges the gap between the push rod 14 and the conductive plate 13, which may fail to push the conductive plate 13 upward. In order to avoid such situation, the push rod 14 and the distal end 141 are made of a wear-proof material such as metal.

It should be appreciated by those skilled in the art that various modifications or variations can be made in the invention without departing from the scope and spirit of the invention. It is intended that the invention include such modifications and variations as come within the scope of the appended claims and their equivalents.

What is claimed is:

1. A safety device for a switch, comprising:

a first terminal;

a second terminal, a first contact point connected to an end of the second terminal;

a conductive plate having a first end fixed to the first terminal and a second contact point connected to a second end of the conductive plate, the second contact point located corresponding to the first contact point; and a push rod located between the first and the second terminals, the push rod located at a side of the conductive plate and a gap defined between a distal end of the push rod and the conductive plate when the first contact point contacts the second contact point, wherein under a current overload condition, the conductive plate is bent and deformed to move the second contact point away from the first contact point, a mediate portion of the conductive plate is bent downward to contact with the end of the push rod and the push rod applies a force to the conductive plate which is moved in a direction away from the first contact point.

2. The device as claimed in claim 1, wherein the push rod is substantially perpendicular to the conductive plate.

3. The device as claimed in claim 1, wherein the distal end of the push rod is of a round shape.

4. The device as claimed in claim 1, wherein the distal end of the push rod is of a flat shape.

5. The device as claimed in claim 1, wherein the distal end of the push rod includes a protrusion.

6. The device as claimed in claim 1, wherein the push rod is made of a wear-proof material.

7. The device as claimed in claim 1, wherein the push rod is made of metal.

* * * * *